US009830847B2

(12) United States Patent
Fujii

(10) Patent No.: US 9,830,847 B2
(45) Date of Patent: Nov. 28, 2017

(54) DISPLAY DEVICE AND METHOD OF DRIVING THE SAME

(71) Applicant: SAMSUNG DISPLAY CO., LTD., Yongin, Gyeonggi-Do (KR)

(72) Inventor: Mitsuru Fujii, Cheonan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 67 days.

(21) Appl. No.: 14/590,762

(22) Filed: Jan. 6, 2015

(65) Prior Publication Data

US 2016/0035264 A1 Feb. 4, 2016

(30) Foreign Application Priority Data

Jul. 29, 2014 (KR) ..... 10-2014-0096566

(51) Int. Cl.
*G09G 3/20* (2006.01)
*G09G 3/3233* (2016.01)

(52) U.S. Cl.
CPC ..... *G09G 3/2003* (2013.01); *G09G 3/3233* (2013.01); *G09G 2310/027* (2013.01); *G09G 2310/0286* (2013.01); *G09G 2320/0247* (2013.01); *G09G 2320/0626* (2013.01); *G09G 2320/0673* (2013.01); *G09G 2330/028* (2013.01)

(58) Field of Classification Search
CPC ..... G09G 2320/0673; G09G 3/2003
See application file for complete search history.

(56) References Cited

U.S. PATENT DOCUMENTS

2008/0084365 A1* 4/2008 Takahara ..... G09G 3/006 345/76
2014/0160173 A1* 6/2014 Lee ..... G09G 3/3225 345/690

FOREIGN PATENT DOCUMENTS

KR 10-2012-0013602 2/2012
KR 10-2013-0036658 4/2013
KR 10-2013-0055257 5/2013

* cited by examiner

*Primary Examiner* — Amare Mengistu
*Assistant Examiner* — Sarvesh J Nadkarni
(74) *Attorney, Agent, or Firm* — Lewis Roca Rothgerber Christie LLP

(57) ABSTRACT

Display device and method of driving the same are provided. According to an embodiment of the present invention, a display device includes a display unit which includes a plurality of pixels, and a control unit which adjusts luminance by maintaining the same gamma gray voltage during a plurality of frames and changing a dimming gain ratio of input data in each frame if a luminance level changes during the frames.

17 Claims, 14 Drawing Sheets

DISPLAY DEVICE AND METHOD OF DRIVING THE SAME

CROSS-REFERENCE TO RELATED APPLICATION

This application claims priority to and the benefit of Korean Patent Application No. 10-2014-0096566, filed on Jul. 29, 2014 in the Korean Intellectual Property Office, the disclosure of which is incorporated herein by reference in its entirety.

BACKGROUND

1. Field

The following description relates to a display device and a method of driving the same, and more particularly, to a display device whose luminance can be changed naturally.

2. Description of the Related Art

A display device displays an image corresponding to an input image by applying scan signals and data voltages to a plurality of pixels. A data voltage applied to each pixel is generated by converting digital input image data into analog input image data using (utilizing) a data driver of the display device. In this digital-to-analog conversion, a gray voltage corresponding to each gray level is used (utilized). The gray voltages are generated using a gamma correction circuit.

Each pixel of an organic electroluminescent display device includes an organic light-emitting diode (OLED) which is a self-emitting element. Each pixel receives a data voltage, generates a driving current from the received data voltage, and supplies the driving current to the OLED. Then, the OLED emits light at a luminance level corresponding to the magnitude of the driving current.

To naturally change the luminance of the organic electroluminescent display device, luminance levels are generally adjusted to be different from one another by equal amounts.

When the luminance of the organic electroluminescent display device is changed rapidly, flicker is less likely to occur. However, when the luminance of the organic electroluminescent display device is changed relatively slowly, a change in the luminance may be perceived as flicker.

SUMMARY

Aspects of embodiments of the present invention are directed toward a display device whose luminance can be changed naturally and a method of driving the display device.

However, aspects of the present invention are not restricted to the one set forth herein. The above and other aspects of the present invention will become more apparent to one of ordinary skill in the art to which the present invention pertains by referencing the detailed description of the present invention given below.

According to an embodiment of the present invention, there is provided a display device including a display unit which includes a plurality of pixels, and a control unit which adjusts luminance by maintaining the same gamma gray voltage during a plurality of frames and changing a dimming gain ratio of input data in each frame if a luminance level changes during the frames.

In one embodiment, the control unit includes a gray voltage generator which generates the gamma gray voltage, and a data driver which provides a data signal corrected by the gamma gray voltage to the display unit.

In one embodiment, the data driver includes a dimming unit which outputs dimming input image data obtained by multiplying the input data by the dimming gain ratio.

In one embodiment, the dimming gain ratio is a ratio of a maximum size of data that can be output to a maximum size of the input data.

In one embodiment, when the input data is N bits, the maximum size of the input data is $2^N-1$.

In one embodiment, the data driver includes a shift register unit, a latch unit, a digital-analog converter (DAC) unit, and a source driver.

In one embodiment, the dimming unit provides the dimming input image data to the shift register unit, and the gray voltage generator is connected to the DAC unit to provide the gamma gray voltage.

In one embodiment, the data driver includes a shift register unit, a latch unit, a DAC unit, and a source driver, wherein the source driver outputs dimming input image data obtained by multiplying the input data by the dimming gain ratio.

In one embodiment, the source driver includes a luminance change calculation unit which determines the amount of change in luminance during the frames; and a data transmission unit which receives the dimming input image data from the dimming unit and provides a data signal to the display unit, wherein the gray voltage generator is connected to the data transmission unit to provide the gamma gray voltage.

In one embodiment, when the duration of the frames is less than 1/15 seconds, the control unit adjusts the luminance by changing the gamma gray voltage in each frame.

According to another embodiment of the present invention, there is provided a method of adjusting luminance of a display device. The method includes measuring a frame duration during which a luminance level changes, and maintaining the same gamma gray voltage during a plurality of frames and changing a dimming gain ratio of input data in each frame if the luminance level changes during the frames.

In one embodiment, the method further includes outputting dimming input image data obtained by multiplying the input data by the dimming gain ratio.

In one embodiment, the dimming gain ratio is a ratio of a maximum size of data that can be output to a maximum size of the input data.

In one embodiment, when the input data is N bits, the maximum size of the input data is $2^N-1$.

In one embodiment, the method further includes correcting the dimming input image data utilizing the gamma gray voltage.

In one embodiment, the method further includes adjusting luminance by changing the gamma gray voltage in each frame when the frame duration during which the luminance level changes is less than 1/15 seconds.

According to still another embodiment of the present invention, there is provided a method of adjusting luminance of a display device. The method includes measuring a frame duration during which a luminance level changes, receiving a change signal for changing the luminance level, and maintaining the same gamma gray voltage during a plurality of frames and changing a dimming gain ratio of input data in each frame if the luminance level changes during the frames, wherein when the change signal is received before the duration of the frames ends, the gamma gray voltage corresponding to the change signal is maintained during the duration of the frames from a frame subsequent to the reception (the receiving) of the change signal.

In one embodiment, the method further includes outputting dimming input image data obtained by multiplying the input data by the dimming gain ratio.

In one embodiment, the dimming gain ratio is a ratio of a maximum size of data that can be output to a maximum size of the input data.

In one embodiment, when the input data is N bits, the maximum size of the input data is $2^N-1$.

BRIEF DESCRIPTION OF THE DRAWINGS

The above and other aspects and features of the present invention will become more apparent by describing in detail exemplary embodiments thereof with reference to the attached drawings, in which.

DETAILED DESCRIPTION

Figure 1:
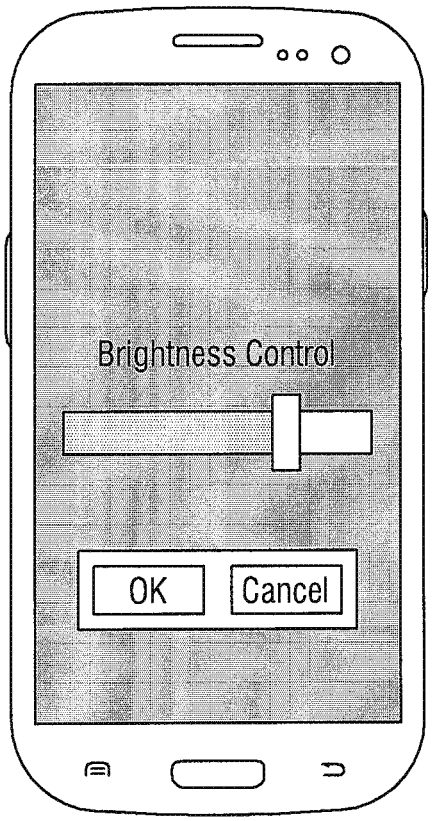
FIG. 1 is a plan view of a display unit of an organic electroluminescent display device according to an embodiment of the present invention.

Advantages and features of the present invention and methods of accomplishing the same may be understood more readily by reference to the following detailed description of example embodiments and the accompanying drawings. The present invention may, however, be embodied in many different forms and should not be construed as being limited to the embodiments set forth herein. Rather, these embodiments are provided so that this disclosure will be thorough and complete and will fully convey the concept of the invention to those skilled in the art, and the present invention will only be defined by the appended claims. Thus, in some embodiments, well-known structures and devices are not shown in order not to obscure the description of the invention with unnecessary detail. Like numbers refer to like elements throughout. In the drawings, the thickness of layers and regions are exaggerated for clarity.

It will be understood that when an element or layer is referred to as being "on," or "connected to" another element or layer, it can be directly on or connected to the other element or layer, or one or more intervening elements or layers may be present. In contrast, when an element is referred to as being "directly on" or "directly connected to" another element or layer, there are no intervening elements or layers present. As used herein, the term "and/or" includes any and all combinations of one or more of the associated listed items.

Spatially relative terms, such as "below," "beneath," "lower," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures.

Embodiments described herein will be described referring to plan views and/or cross-sectional views by way of ideal schematic views of the invention. Accordingly, the example views may be modified depending on manufacturing technologies and/or tolerances. Therefore, the embodiments of the invention are not limited to those shown in the views, but include modifications in configuration formed on the basis of manufacturing processes. Therefore, regions exemplified in figures have schematic properties and shapes of regions shown in figures exemplifying specific shapes of regions of elements and do not limit aspects of the invention.

Hereinafter, embodiments of the present invention will be described with reference to the attached drawings.

FIG. 1 is a plan view of a display unit of an organic electroluminescent display device according to an embodiment of the present invention.

Referring to FIG. 1, a brightness control bar is displayed on the display unit of the organic electroluminescent display device. A user can change the luminance of the organic electroluminescent display device to a desired level by moving the brightness control bar located on the display unit. However, if the brightness control bar is moved slowly, for example, if the luminance of the organic electroluminescent display device is changed by one level during four frames, it is likely the luminance of the organic electroluminescent display device is changed at a frequency of 15 Hz. Therefore, flicker can be seen.

Here, the luminance of the organic electroluminescent display device is not necessarily changed by one level during four frames and can be changed at any frequency that can cause flicker.

Figure 2:
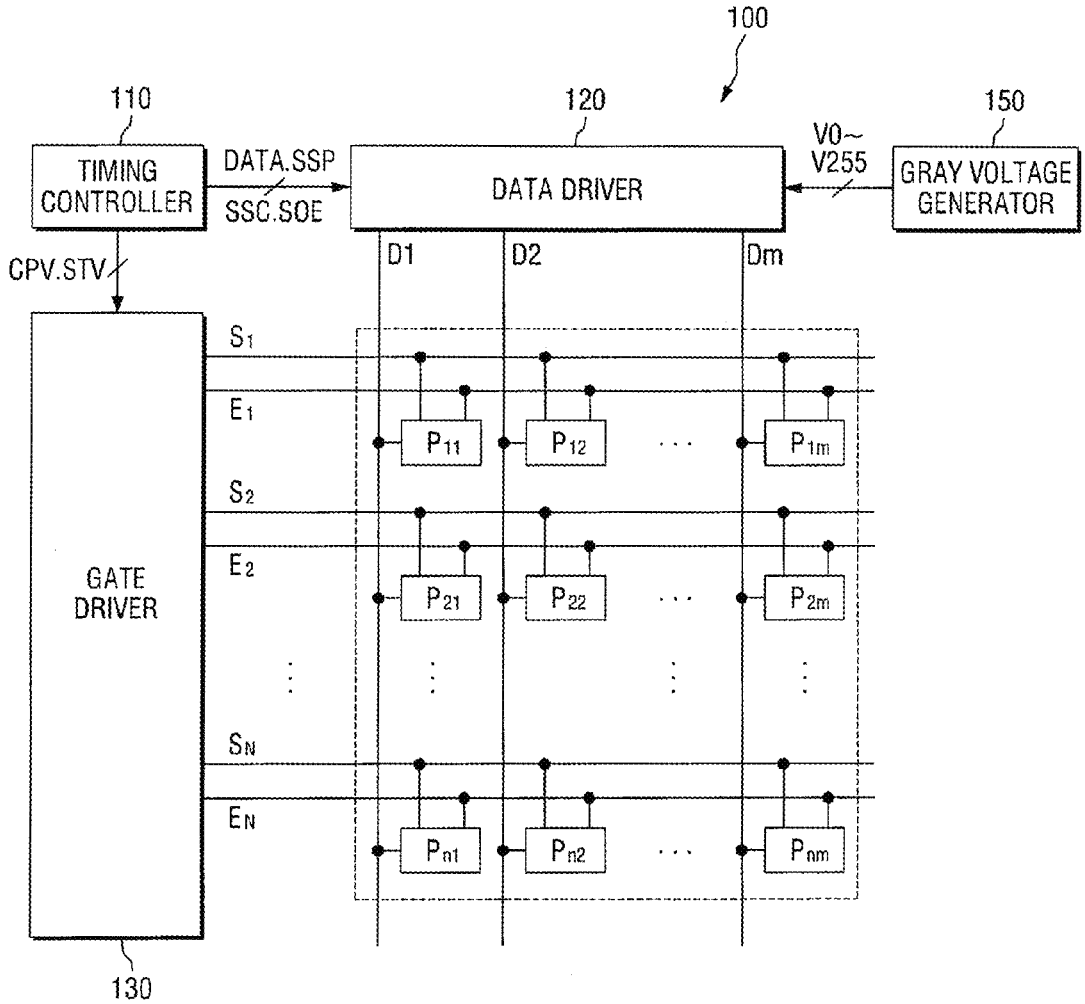
FIG. 2 is a block diagram of an organic electroluminescent display device according to an embodiment of the present invention.
Figure 3:
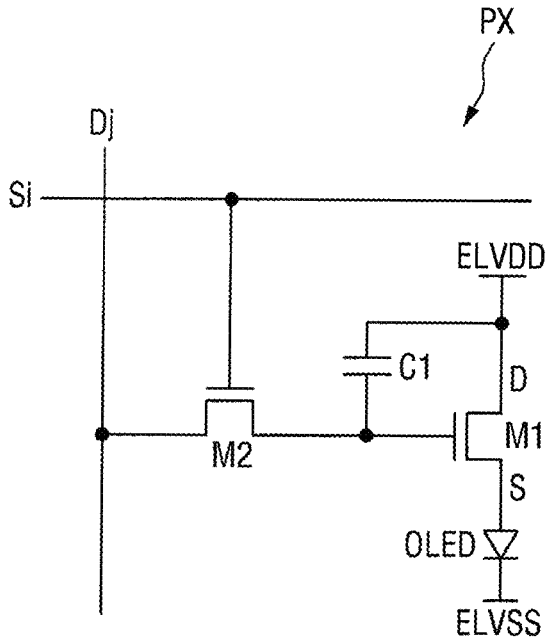
FIG. 3 is a circuit diagram of an example pixel of the organic electroluminescent display device illustrated in FIG. 2.

FIG. 2 is a block diagram of an organic electroluminescent display device 100 according to an embodiment of the present invention. FIG. 3 is a circuit diagram of an example pixel of the organic electroluminescent display device 100 illustrated in FIG. 2.

Referring to FIG. 2, the organic electroluminescent display device 100 according to the current embodiment may include a timing controller 110 which generates and outputs control signals to a data driver 120 and a gate driver 130, the data driver 120 which outputs data voltages corresponding to an input image to a plurality of pixels P11 through Pnm via a plurality of data lines D1 through Dm, the gate driver 130 which outputs scan signals to the pixels P11 through Pnm via scan lines S1 through Sn and outputs emission control signals to the pixels P11 through Pnm via emission control lines E1 through En, a pixel unit 140 which includes the pixels P11 through Pnm connected to the scan lines S1 through Sn, the emission control lines E1 through En and the data lines D1 through Dm, and a gray voltage generator 150 which generates a plurality of gray voltages V0 through V255 and applies the gray voltages V0 through V255 to the data driver 120.

The timing controller 110 may receive an input image signal and an input control signal for controlling the display of the input image signal from an external graphics controller. The timing controller 110 generates input image data DATA, a source start pulse SSP, a source shift clock SSC and a source output enable SOE from the input image signal and the input control signal and provides the input image data DATA, the source start pulse SSP, the source shift clock SSC and the source output enable SOE to the data driver 120. In addition, the timing controller 110 generates a gate driving clock CPV and a start pulse SW and outputs the gate driving clock CPV and the start pulse SW to the gate driver 130.

The pixel unit 140 includes the pixels P11 through Pnm located at crossing regions (e.g., at intersections) of the scan lines S1 through Sn and the data lines D1 through Dm. The pixels P11 through Pnm may be arranged in an m×n matrix as illustrated in FIG. 1. Each of the pixels P11 through Pnm includes a light-emitting element and receives from an external source a high power supply voltage ELVDD and a low power supply voltage ELVSS for making the light-emitting element emit light. In addition, each of the pixels P11 through Pnm makes the light-emitting element emit light at a luminance level corresponding to a data voltage by supplying a driving current or voltage to the light-emitting element. The light-emitting element may be an organic light-emitting diode OLED.

Each of the pixels P11 through Pnm may control the amount of current supplied to the organic light-emitting diode OLED in response to a data voltage received through one of the data lines D1 through Dm. The organic light-emitting diode OLED may emit light at a luminance level corresponding to the data voltage in response to an emission control signal received through one of the emission control lines E1 through En.

Referring to FIG. 3, pixel circuits 210 according to embodiments of the present invention may be implemented as N-type (N-channel) transistors or P-type (P-channel) transistors. Embodiments of the present invention will hereinafter be described based on the pixel circuits 210 implemented as N-type transistors.

A pixel PX includes an organic light-emitting diode OLED and a pixel circuit 210. The organic light-emitting diode OLED emits light when receiving a driving current from the pixel circuit 210, and the luminance of the light emitted from the organic light-emitting diode OLED varies according to the magnitude of the driving current.

The pixel circuit 210 may include a capacitor C1, a drive transistor M1, and a scan transistor M2. The drive transistor M1 may include a first terminal D which receives the high power supply voltage ELVDD, a second terminal S which is connected to an anode of the organic light-emitting diode OLED, and a gate terminal which is connected to a second terminal of the scan transistor M2. The anode of the organic light-emitting diode OLED is connected to the second terminal S of the drive transistor M1, and a cathode of the organic light-emitting diode OLED is connected to the low power supply voltage ELVSS. The scan driver M2 may include a first terminal connected to a data line Dj, the second terminal connected to the gate terminal of the drive transistor M1, and a gate terminal connected to a scan line Si. The capacitor C1 is connected between the gate terminal and the first terminal D of the drive transistor M1.

When a scan signal having a gate-on level is transmitted to the scan transistor M2 via the scan line Si, a data voltage is applied to the gate terminal of the drive transistor M1 and a first terminal of the capacitor C1 via the scan transistor M2. While the effective data voltage is applied through the data line Dj, the storage capacitor C1 is charged to a level corresponding to the data voltage. The drive transistor M1 generates a driving current according to the level of the data voltage and outputs the driving current to the organic light-emitting diode OLED.

The organic light-emitting diode OLED receives the driving current from the pixel circuit 210 and emits light at a luminance level corresponding to the data voltage.

The data driver 120 generates data voltages using (utilizing) the input image data DATA, the source start pulse SSP, the source shift clock SSC and the source output enable SOE received from the timing controller 110 and outputs the data voltages to the pixels P11 through Pnm via the data lines D1 through Dm. The data voltages may be output to a plurality of pixels in the same row during one horizontal period. In addition, each of the data lines D1 through Dm which deliver the data voltages may be connected to a plurality of pixels located in the same column.

Figure 4:
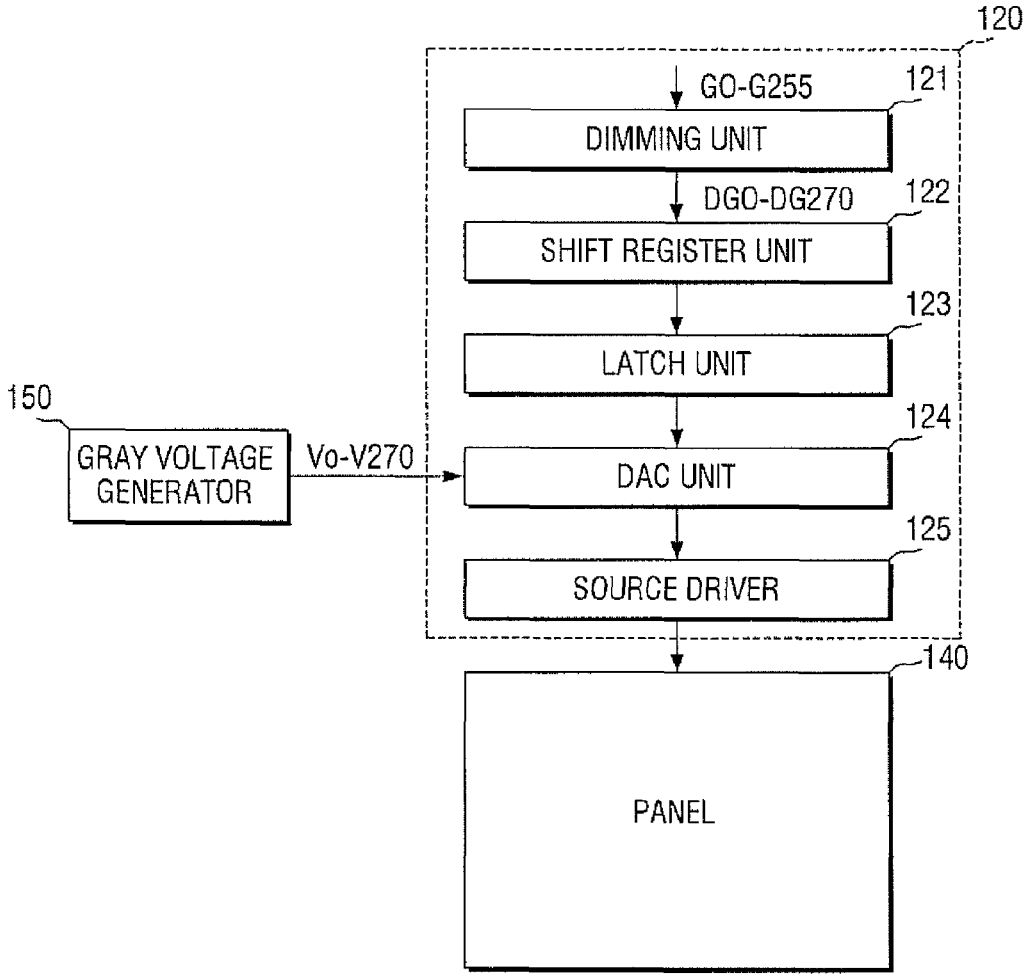
FIG. 4 is a diagram illustrating the structure of a data driver according to an embodiment of the present invention.

FIG. 4 is a diagram illustrating the structure of a data driver 120 according to an embodiment of the present invention.

Referring to FIG. 4, the data driver 120 may include a dimming unit 121, a shift register unit 122, a latch unit 123, a digital-analog converter (DAC) unit 124, and a source driver 125.

The dimming unit 121 receives the source start pulse SSP, the source shift clock SSC and image signals G0 through G255 from the timing controller 110. The dimming unit 121 may send the source shift clock SSC and the source start pulse SSP to the shift register unit 122. The dimming unit 121 which receives the image signals G0 through G255 may obtain an increased or reduced output value by applying a ratio (hereinafter, referred to as a 'dimming gain ratio DPR') of a dimming output value to an input gray voltage to the input gray voltage. The dimming gain ratio DPR may be a value obtained by dividing a maximum value of data that can be output by a maximum size of the data. For example, if input data is 8-bit data, the maximum size of the input data is fixed to a gray value of 255. Therefore, the dimming gain ratio DPR may vary according to the magnitude of the maximum value of data that can be output. For example, data G0 through G255 corresponding to 0 to 255 gray levels and transmitted to the dimming unit 121 can be output as dimming input image data DG0 through DG270 corresponding to 0 through 270 gray levels according to the dimming gate ratio DPR. The principle of driving the dimming unit 121 will be described in more detail later with reference to FIG. 7.

The shift register unit 122 sequentially generates m sampling signals by shifting the source start pulse SSP in each period of the source shift clock SSC. To this end, the shift register unit 122 may include m shift registers 1221 through 122*m*.

The latch unit 123 sequentially stores the dimming input image data DG0 through DG270 in response to the sampling signals sequentially received from the shift register unit 122. To this end, the latch unit 123 may include m latches 1231 through 123*m* to store m input image data DATA. In addition, the latch unit 123 receives the source output enable signal SOE from the timing controller 110. The latch unit 123 supplies the dimming input image data DG0 through DG270 stored therein to the DAC unit 124.

The DAC unit 124 receives the dimming input image data DG0 through DG270 from the latch unit 123 and gray voltages V0 through V270 from the gray voltage generator 150 and generates m data voltages corresponding to the received dimming input image data DG0 through DG270. To this end, the DAC unit 124 may include m DACs 1241 through 124*m*. That is, the DAC unit 124 generates the m data voltages using the DACs 1241 through 124*m* corresponding to each channel and supplies the m data voltages to the source driver 125.

The source driver 125 supplies the m data voltages received from the DAC unit 124 to the m data lines D1 through Dm, respectively. To this end, the source driver 125 includes m buffers 1251 through 125*m*.

The gate driver 130 (see FIG. 2) generates scan signals and emission control signals using the gate driving clock CPV and the start pulse STV received from the timing controller 110 and outputs the scan signals and the emission control signals to the pixels P11 through Pnm via the scan lines S1 through Sn and the emission control lines E1 through En. Each of the scan lines S1 through Sn and each of the emission control lines E1 through En may be connected to a plurality of pixels located in the same row. The scan lines S1 through Sn and the emission control lines E1 through En may sequentially or simultaneously output the scan signals and the emission control signals on a row-by-row basis. In an implementation example of the organic electroluminescent display device 100, the gate driver 130 may generate an additional driving signal and output the additional driving signal to each of the pixels P11 through Pnm.

The gray voltage generator 150 may generate a plurality of gamma-corrected gray voltages V0 through V270 and output the gamma-corrected gray voltages V0 through V270 to the source driver 125.

The number of the gray voltages V0 through V270 may vary according to the number of gray levels expressed by the organic electroluminescent display device 100. In the present specification, an embodiment in which the organic electroluminescent display device 100 has 256 gray levels will be described. However, since the magnitude of the maximum value of data that can be output can be changed, the organic electroluminescent display device 100 can have more than 256 gray levels.

According to embodiments of the present invention, when the organic electroluminescent display device 100 performs dimming, the gray voltage generator 150 may generate the dimming input image data DG0 through DG270 through the dimming unit 121 and provide data of desired gray levels using the gray voltages VO through V270. The gray voltages V0 through V270 may be generated by referring to a reference voltage table stored in advance, and the data of the desired gray levels may be provided using the gray voltages V0 through V270.

In addition, each of the gamma gray voltages V0 through V270 may vary according to the magnitude of gamma, and the maximum value of data that can be output can be adjusted according to the magnitude of gamma.

Figure 5:
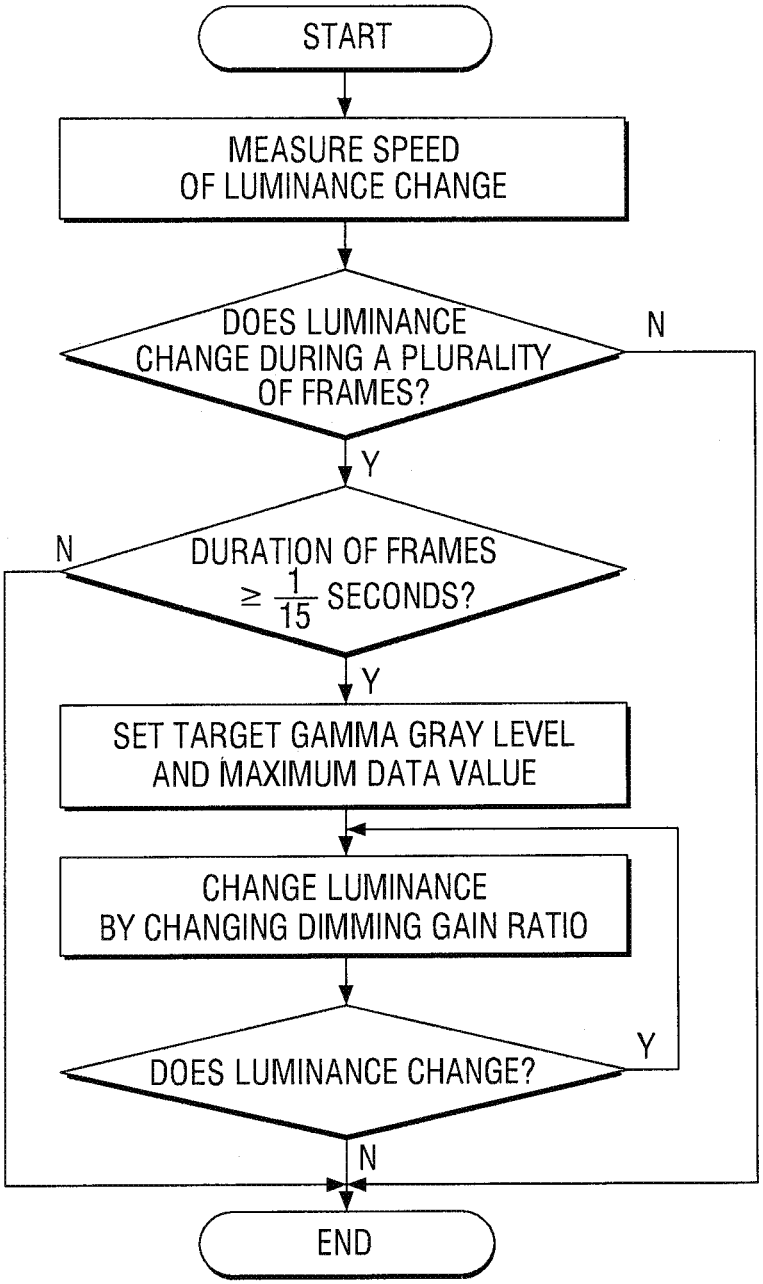
FIG. 5 is a flowchart illustrating the principle of driving an organic electroluminescent display device according to an embodiment of the present invention.

FIG. 5 is a flowchart illustrating the principle of driving an organic electroluminescent display device according to an embodiment of the present invention.

Referring to FIG. 5, the speed of luminance change is measured to determine whether luminance changes during a plurality of frames. When the luminance changes in each individual frame, the change cannot be perceived as flicker. Thus, dimming according to an embodiment of the present invention may not be performed.

When the luminance changes over a plurality of frames, it may be determined whether the duration of the frames is equal to or greater than 1/15 seconds (assumed to be a frame duration which corresponds to a frequency of 15 Hz and during which a person can perceive flicker). If the duration of the frames is equal to or greater than 1/15 seconds, a change in the luminance can be perceived as flicker. Therefore, a target gamma gray level may be set, and the maximum value of data that can be output may be set. In this case, a gray level may be fixed to the set target gamma gray level, and the luminance may be changed in each frame using the dimming gain ratio DPR changed according to an input gray level. If the luminance changes continuously even after it has been changed to a luminance level corresponding to the target gamma gray level, the target gamma gray level (voltage) is set again. Then, the luminance may be changed in each frame using the dimming gain ratio DPR.

Figure 6:
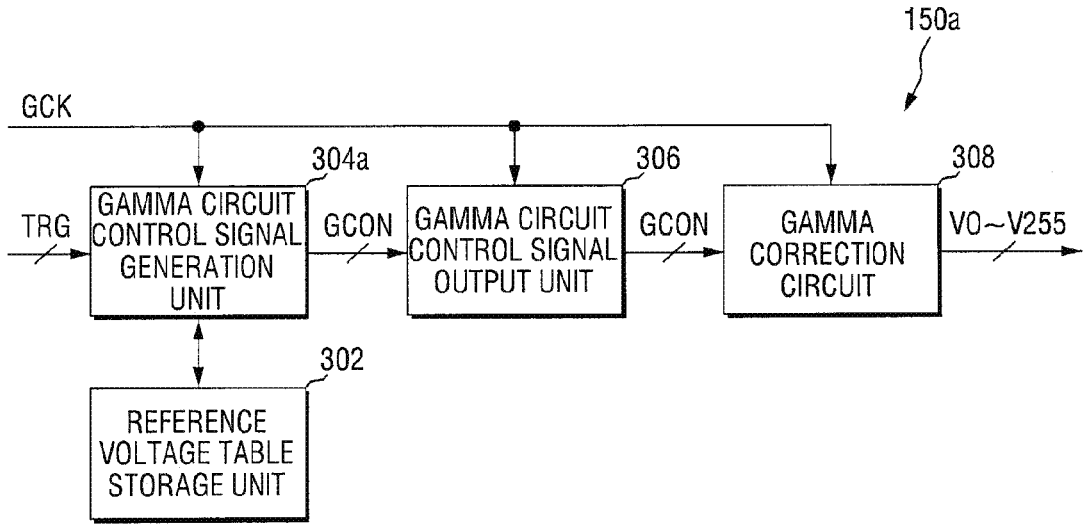
FIG. 6 is a block diagram of a gray voltage generator according to an embodiment of the present invention.

FIG. 6 is a block diagram of a gray voltage generator 150*a* according to an embodiment of the present invention.

Referring to FIG. 6, the gray voltage generator 150*a* according to the current embodiment may include a reference voltage table storage unit 302, a gamma circuit control signal generation unit 304*a*, a gamma circuit control signal output unit 306, and a gamma correction circuit 308.

The reference voltage table storage unit 302 may store a reference voltage table including gamma voltage control signals according to luminance levels.

The reference voltage table may be stored as illustrated in FIG. 6.

The circuit control signal generation unit (e.g., gamma circuit control signal generator) 304*a* generates a gamma circuit control signal GCON that is to be provided to the gamma correction circuit 308. According to embodiments of the present invention, the luminance level of the organic electroluminescent display device 100 can be adjusted by controlling the sizes of gray voltages V0 through V255 that are to be output from the gamma correction circuit 308. To this end, the gamma circuit control signal generation unit 304*a* receives target luminance information TRG indicating the target luminance level of the organic electroluminescent display device 100 and determines the gamma circuit control signal GCON that is to be provided to the gamma correction circuit 308*a* based on the target luminance information TRG, thereby adjusting the luminance level of the organic electroluminescent display device 100.

The gamma circuit control signal GCON may be determined for each of red (R), green (G) and blue (B).

According to an embodiment of the present invention, when the target luminance level included in the target luminance information TRG changes, the gamma circuit control signal generation unit 304*a* generates the gamma circuit control signal GCON at each dimming step (act) in order to change the luminance of the organic electroluminescent display device 100 step by step. Here, a gamma circuit control signal GCON corresponding to the target luminance level and gamma circuit control signals GCONs corresponding to intermediate luminance levels between a current luminance level and the target luminance level are searched for in the reference voltage table storage unit 302. The number of the intermediate luminance levels may be determined according to the number of dimming steps. The gamma circuit control signal generation unit 304*a* may determine the gamma circuit control signal GCON that is to be provided to the gamma correction circuit 380 using the gamma circuit control signals GCONs found in the reference voltage table storage unit 302. The gamma circuit control signal output unit 306 may output the gamma circuit control signal GCON generated by the gamma circuit control signal generation unit 304*a* to the gamma correction circuit 308. To adjust the luminance level of the organic electroluminescent display device 10 step by step, the gamma circuit control signal output unit 306 may output the gamma circuit control signal GCON in each period of a gamma circuit clock signal GCK in synchronization with the gamma circuit clock signal GCK.

In addition, to change the luminance level of the organic electroluminescent display device 100 step by step, the gamma circuit control signal generation unit 304*a* may sequentially output the gamma circuit control signals GCONs corresponding to the intermediate luminance levels and the target luminance level to the gamma circuit control signal output unit 306 in each period of the gamma circuit clock signal GCK, and the gamma circuit control signal output unit 306 may output the gamma circuit control signals GCONs received from the gamma circuit control signal generation unit 304*a* to the gamma correction circuit 308 in synchronization with the gamma circuit clock signal GCK. The gamma circuit control signal output unit 306 may be a flipflop or latch that operates in synchronization with the gamma circuit clock signal GCK.

The gamma correction circuit 308 may generate gray voltages V0 through V270 according to the gamma circuit control signals GCONs output from the gamma circuit control signal output unit 306 and output the gray voltages V0 through V270 to the data driver 120.

Figure 7:
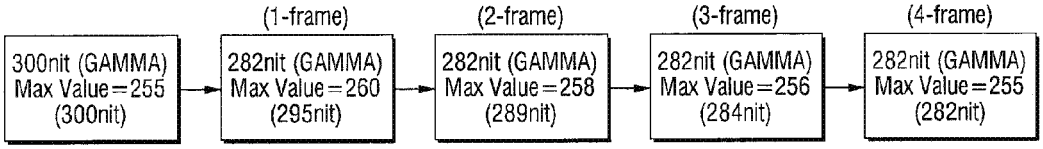
FIG. 7 is a flowchart illustrating the principle of changing luminance from a high gray level to a low gray level according to an embodiment of the present invention.
Figure 8:
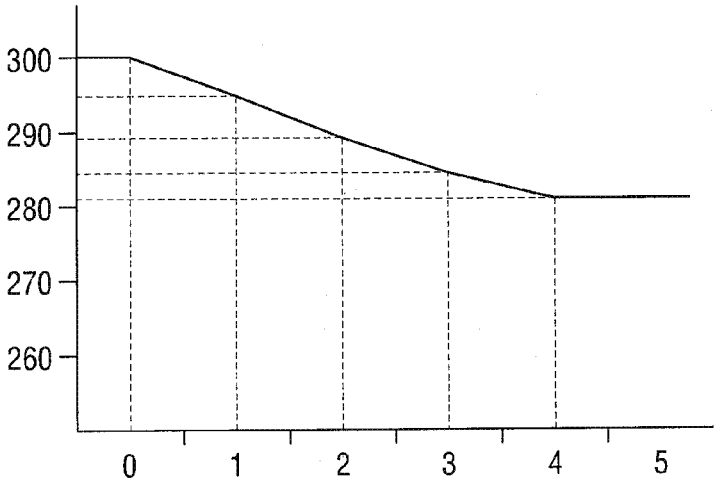
FIG. 8 is a graph illustrating the variation in a dimming gain ratio utilized to change luminance in FIG. 7.

FIG. 7 is a flowchart illustrating the principle of changing luminance from a high gray level to a low gray level according to an embodiment of the present invention. FIG. 8 is a graph illustrating the variation in the dimming gain ratio utilized to change luminance in FIG. 7.

Referring to FIG. 7, luminance can be changed naturally by reducing a maximum value that can be output while maintaining the same gamma gray level (gamma) during first through fourth frames. Before the change in the luminance, the gamma gray level (gamma) and a displayed gray level (nit) are equal, and the maximum value that can be output is 255 corresponding to 8 bits.

In the first frame, a gamma gray level of 282 nits is fixed as a target value, and the maximum value that can be output is set to a value (260) exceeding a size (255) of 8-bit data. Since the magnitude of the maximum value that can be output exceeds the size of the 8-bit data, the dimming gain ratio is greater than one. Therefore, the luminance can be changed more effectively than in a general case where the dimming gain ratio is one.

In the second frame, the same gamma gray level (282 nits) as that of the first frame is fixed as the target value, and the maximum value that can be output is set to a value (258) exceeding the size (255) of the 8-bit data. Since the magnitude of the maximum value that can be output exceeds the size of the 8-bit data, the dimming gain ratio is greater than one. Therefore, the luminance can be changed more effectively than in the general case where the dimming gain ratio is one.

In the third frame, the same gamma gray level (282 nits) as that of the first frame is fixed as the target value, and the maximum value that can be output is set to a value (256) exceeding the size (255) of the 8-bit data. Although the magnitude of the maximum value that can be output exceeds the size of the 8-bit data, the dimming gain ratio is close to one. Therefore, the luminance may be changed less.

In the fourth frame, the same gamma gray level (282 nits) as that of the first frame is fixed as the target value. However, the maximum value that can be output may be equal to the size (255) of the 8-bit data, and the gamma gray level (282 nits) may be equal to the changed luminance (282 nits).

A first step (act) of luminance change is completed through the first through fourth frames, and a next step of luminance change may be performed in the same way as described above.

In the current embodiment, the method of changing luminance by maintaining the same gamma gray level during the first through fourth frames is disclosed. However, the present invention is not limited thereto, and the current embodiment can be applied to a method of changing luminance naturally by maintaining the same gamma gray level during a plurality of frames.

Referring to FIG. 8, the dimming gain ratio varies in each frame. The dimming gain ratio is a ratio of the maximum size of input data and the maximum value of data that can be output. However, since the maximum size of 8-bit data that can be input is fixed to 255, the dimming gain ratio corresponds to the maximum value of data that can be output.

Figure 9:
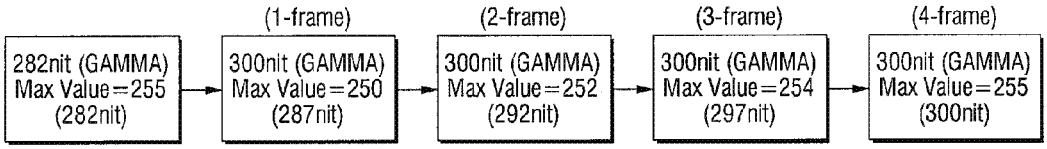
FIG. 9 is a flowchart illustrating the principle of changing luminance from a low gray level to a high gray level according to an embodiment of the present invention.
Figure 10:
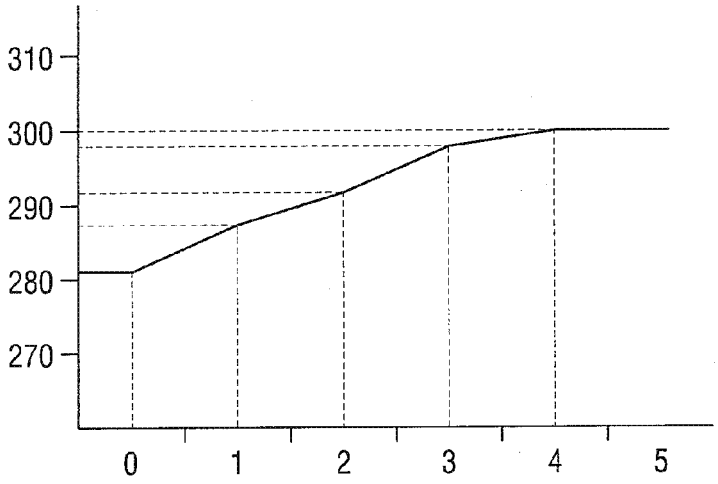
FIG. 10 is a graph illustrating the variation in the dimming gain ratio utilized to change luminance in FIG. 9.

FIG. 9 is a flowchart illustrating the principle of changing luminance from a low gray level to a high gray level according to an embodiment of the present invention. FIG. 10 is a graph illustrating the variation in the dimming gain ratio utilized to change luminance in FIG. 9.

Referring to FIG. 9, luminance can be changed naturally by increasing a maximum value that can be output while maintaining the same gamma gray level (gamma) during first through fourth frames. Before the change in the luminance, the gamma gray level (gamma) and a displayed gray level (nit) are equal, and the maximum value that can be output is 255 corresponding to 8 bits.

In the first frame, a gamma gray level of 300 nits is fixed as a target value, and the maximum value that can be output is set to a value (250) smaller than a size (255) of 8-bit data. Since the magnitude of the maximum value that can be output is smaller than the size of the 8-bit data, the dimming gain ratio is less than one.

Therefore, the luminance can be changed more effectively than in a general case where the dimming gain ratio is one.

In the second frame, the same gamma gray level (300 nits) as that of the first frame is fixed as the target value, and the maximum value that can be output is set to a value (252) smaller than the size (255) of the 8-bit data. Since the magnitude of the maximum value that can be output is smaller than the size of the 8-bit data, the dimming gain ratio is less than one. Therefore, the luminance can be changed more effectively than in the general case where the dimming gain ratio is one.

In the third frame, the same gamma gray level (300 nits) as that of the first frame is fixed as the target value, and the maximum value that can be output is set to a value (254) smaller than the size (255) of the 8-bit data. Although the magnitude of the maximum value that can be output is smaller than the size of the 8-bit data, the dimming gain ratio is close to one. Therefore, the luminance may be changed less.

In the fourth frame, the same gamma gray level (300 nits) as that of the first frame is fixed as the target value. However, the maximum value that can be output may be equal to the size (255) of the 8-bit data, and the gamma gray level (300 nits) may be equal to the changed luminance (300 nits).

A first step of luminance change is completed through the first through fourth frames, and a next step of luminance change may be performed in the same way as described above.

In the current embodiment, the method of changing luminance by maintaining the same gamma gray level during the first through fourth frames is disclosed. However, the present invention is not limited thereto, and the current embodiment can be applied to a method of changing luminance naturally by maintaining the same gamma gray level during any suitable number of frames.

Referring to FIG. 10, the dimming gain ratio varies in each frame. The dimming gain ratio is a ratio of the maximum size of input data and the maximum value of data that can be output. However, since the maximum size of 8-bit data that can be input is fixed to 255, the dimming gain ratio corresponds to the maximum value of data that can be output.

Figure 11:
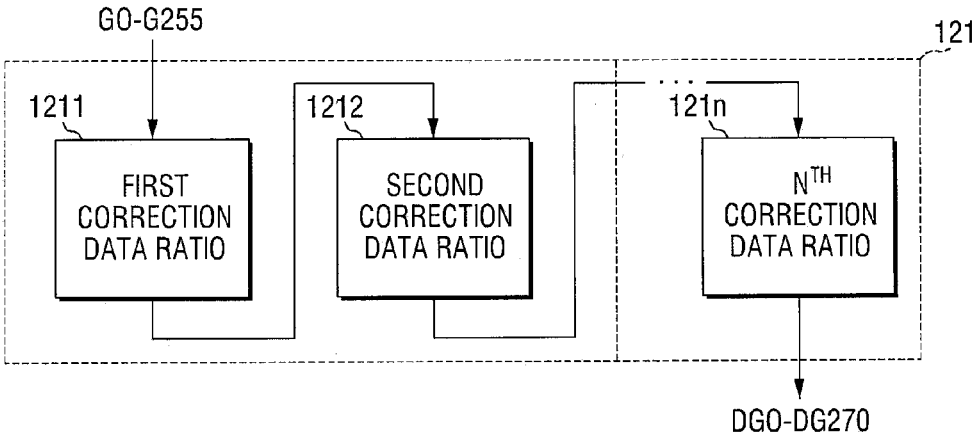
FIG. 11 is a block diagram illustrating a method of changing data using a dimming unit according to an embodiment of the present invention.

FIG. 11 is a block diagram illustrating a method of changing data using the dimming unit 121 according to an embodiment of the present invention.

Referring to FIG. 11, the dimming unit 121 may output dimming input image data DG0 through DG270 through a plurality of steps. The number of steps (1211 through 121*n*) corresponds to the number of frames during which luminance is changed while the same gamma gray level is maintained.

A first correction data ratio of a first correction step 1211 denotes a dimming gain ratio corresponding to a maximum value of data that can be output for a first time. A second correction data ratio of a second correction step 1212 denotes a dimming gain ratio corresponding to a maximum value of data that can be output for a second time. An $n^{th}$ correction data ratio of an $n^{th}$ correction step 121 n denotes a dimming gain ratio corresponding to a maximum value of data that can be output for an $n^{th}$ time.

Through the above steps, the dimming unit 121 can output the dimming input image data DG0 through DG270 corresponding to 0 through 270 gray levels.

Figure 12:
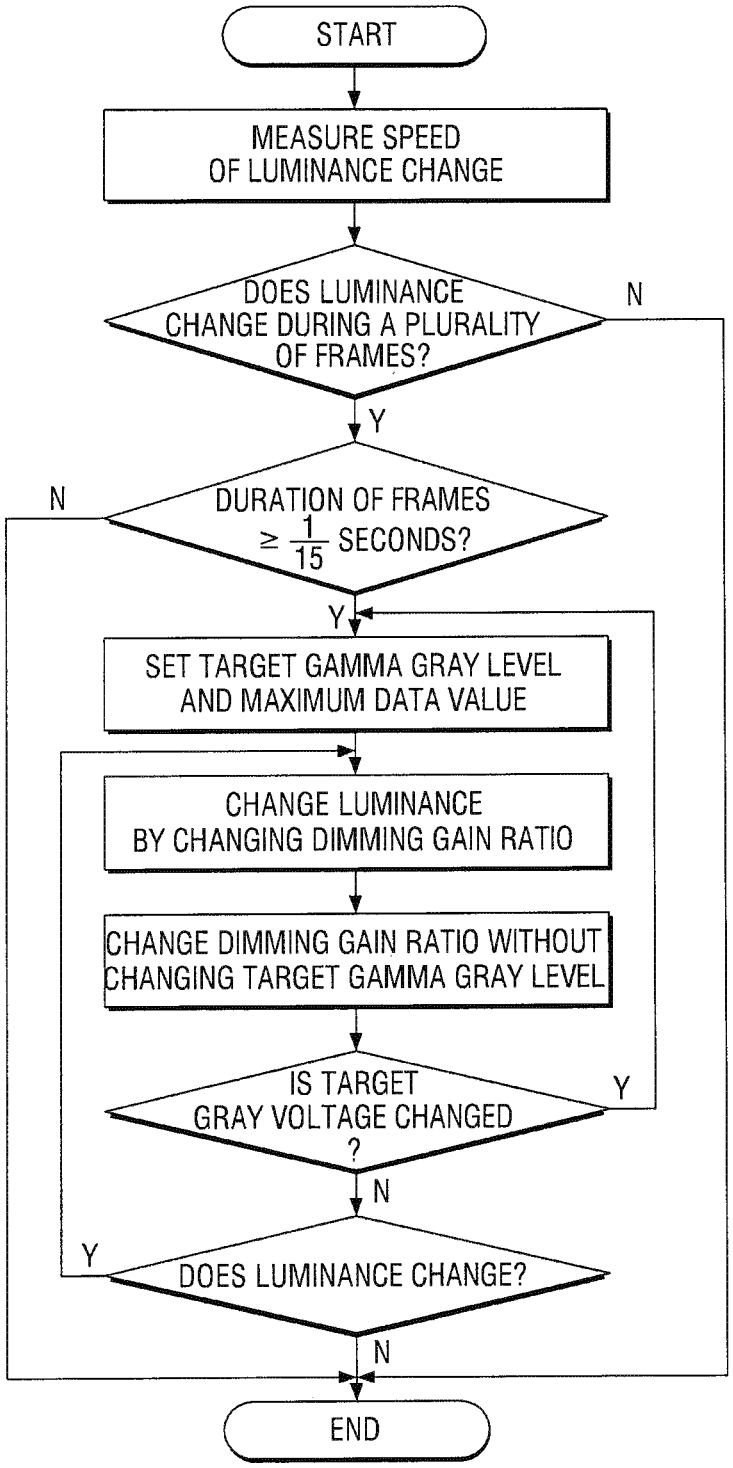
FIG. 12 is a flowchart illustrating the principle of driving an organic electroluminescent display device according to another embodiment of the present invention.

FIG. 12 is a flowchart illustrating the principle of driving an organic electroluminescent display device according to another embodiment of the present invention.

Referring to FIG. 12, the speed of luminance change is measured to determine whether luminance changes during a plurality of frames. When the luminance changes in each individual frame, the change cannot be perceived as flicker. Thus, dimming according to another embodiment of the present invention may not need to be performed.

When the luminance changes over a plurality of frames, it may be determined whether the duration of the frames is equal to or greater than 1/15 seconds (assumed to be a frame duration which corresponds to a frequency of 15 Hz and during which a person can perceive flicker). If the duration of the frames is equal to or greater than 1/15 seconds, a change in the luminance can be perceived as flicker. Therefore, a target gamma gray level may be set, and the maximum value of data that can be output may be set. In this case, a gray level may be fixed to the set target gamma gray level, and the luminance may be changed in each frame using the dimming gain ratio DPR changed according to an input gray level. If the target gamma gray level is changed before the changed luminance reaches a luminance level corresponding to the target gamma gray level, the target gamma gray level may be set again, and the maximum value of data that can be output may also be set again. In addition, if the luminance changes continuously even after it has been changed to a luminance level corresponding to the target gamma gray level, the target gamma gray level (voltage) is set again. Then, the luminance may be changed in each frame using the dimming gain ratio DPR.

Figure 13:
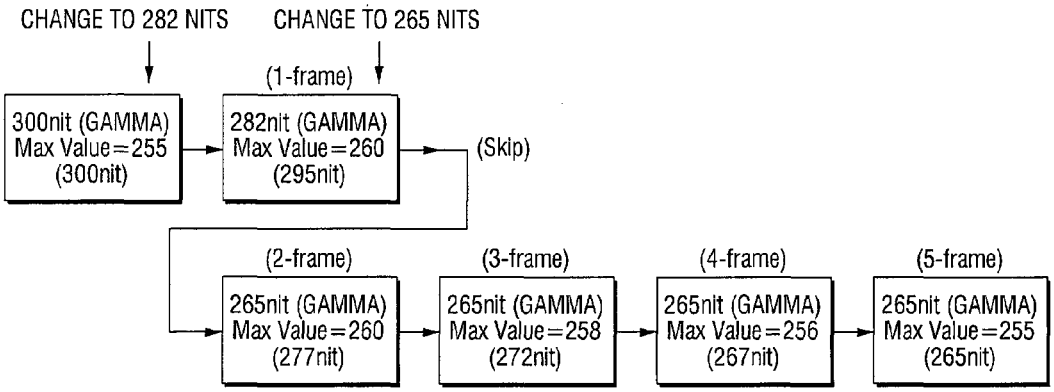
FIG. 13 is a flowchart illustrating the principle of changing luminance in each frame from a high gray level to a low gray level.
Figure 14:
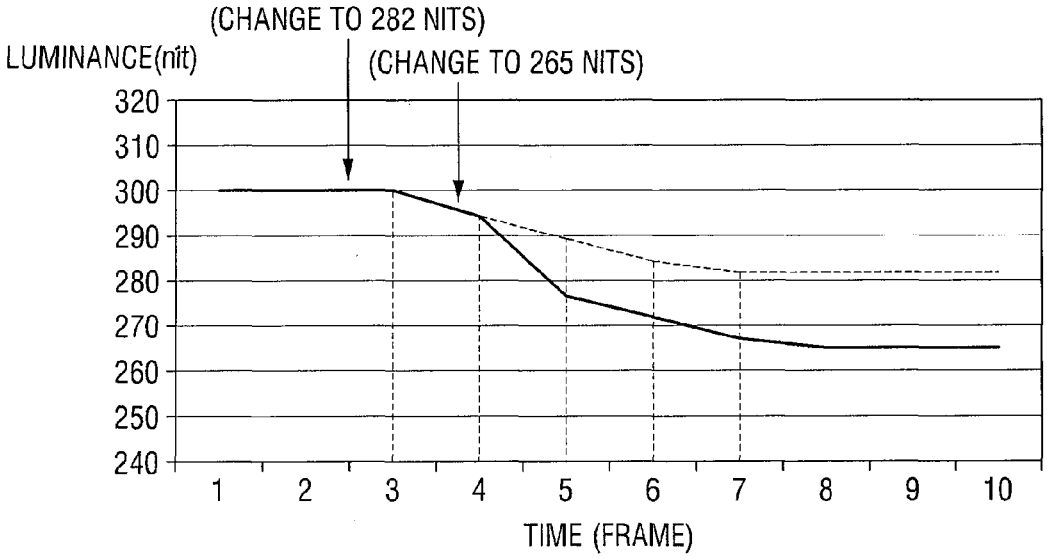
FIG. 14 is a graph illustrating the variation in the dimming gain ratio utilized to change luminance in FIG. 13.

FIG. 13 is a flowchart illustrating the principle of changing luminance in each frame from a high gray level to a low gray level. FIG. 14 is a graph illustrating the variation in the dimming gain ratio utilized to change luminance in FIG. 13.

Referring to FIG. 13, when a change signal for changing a luminance level is received in the process of changing luminance, target luminance may be changed quickly, and then the luminance may be changed naturally using the dimming gain ratio DPR in the same way as the embodiment of FIG. 7.

In a first frame, the luminance may be gradually changed using the dimming gain ratio DPR in a state where a target gamma gray level is fixed to a first gamma gray level (282 nits). While the luminance is being changed, if target luminance is newly set, the target gamma gray level may be set to a third gamma gray level (265 nits) in a second frame, and then the luminance may be changed. The luminance may sharply change from 295 nits to 277 nits during a switch from the first frame to the second frame. A sharp change in luminance during a short period of time does not cause flicker. Therefore, the luminance changing process being performed by setting the first gamma gray level (282 nits) as the target gamma gray level may be partially skipped.

In the second frame, the gamma gray level of 265 nits is fixed as the target gamma gray level, and the maximum value that can be output is set to a value (260) exceeding the size (255) of 8-bit data. Since the magnitude of the maximum value that can be output exceeds the size of the 8-bit data, the dimming gain ratio is greater than one. Therefore, the luminance can be changed more effectively than in a general case where the dimming gain ratio is one.

In a third frame, the same gamma gray level (265 nits) as that of the second frame is fixed as the target gamma gray level, and the maximum value that can be output is set to a value (258) exceeding the size (255) of the 8-bit data. Since the magnitude of the maximum value that can be output exceeds the size of the 8-bit data, the dimming gain ratio is greater than one. Therefore, the luminance can be changed more effectively than in the general case where the dimming gain ratio is one.

In a fourth frame, the same gamma gray level (265 nits) as that of the second frame is fixed as the target gamma gray level, and the maximum value that can be output is set to a value (256) exceeding the size (255) of the 8-bit data. Although the magnitude of the maximum value that can be output exceeds the size of the 8-bit data, the dimming gain ratio is close to one. Therefore, the luminance may be changed less.

In a fifth frame, the same gamma gray level (265 nits) as that of the second frame is fixed as the target gamma gray level. However, the maximum value that can be output may be equal to the size (255) of the 8-bit data, and the gamma gray level (265 nits) may be equal to the changed luminance (265 nits).

In the current embodiment, the method of changing luminance by changing the gamma gray level (gamma) after the first frame and then maintaining the same third gamma gray level (265 nits) during the second through fifth frames is disclosed. However, the present invention is not limited thereto, and methods of changing luminance according to other embodiments of the present invention can be utilized in various situations.

Referring to FIG. 14, the dimming gain ratio varies in each frame. The dimming gain ratio is a ratio of a maximum size of input data and a maximum value of data that can be output. However, since the maximum size of 8-bit data that can be input is fixed to 255, the dimming gain ratio corresponds to the maximum value of data that can be output. In FIG. 14, luminance changes sharply in a section from the first frame to the second frame. However, this change may not result from a change in the maximum value of data that can be output. In addition, the luminance can be changed by significantly changing the maximum value of data that can be output. However, this change may not result from a change in the dimming gain ratio.

Figure 15:
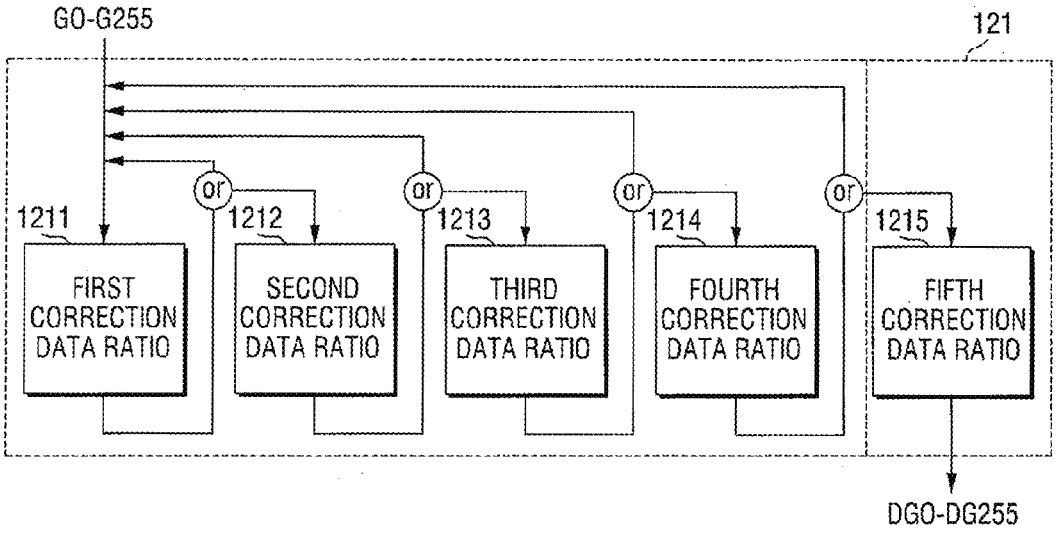
FIG. 15 is a block diagram illustrating a method of changing data using a dimming unit according to another embodiment of the present invention.

FIG. 15 is a block diagram illustrating a method of changing data using the dimming unit 121 according to another embodiment of the present invention.

Referring to FIG. 15, the dimming unit 121 may output dimming input image data DG0 through DG270 through a plurality of steps. The number of steps (1211 through 1215) corresponds to the number of frames during which luminance is changed while the same gamma gray level is maintained.

A first correction data ratio of a first correction step 1211 denotes a dimming gain ratio corresponding to a maximum value of data that can be output for a first time. A second correction data ratio of a second correction step 1212 denotes a dimming gain ratio corresponding to a maximum value of data that can be output for a second time. A third correction data ratio of a third correction step 1213 denotes a dimming gain ratio corresponding to a maximum value of data that can be output for a third time. A fourth correction data ratio of a fourth correction step 1214 denotes a dimming gain ratio corresponding to a maximum value of data that can be output for a fourth time. A fifth correction data ratio of a fifth correction step 1215 denotes a dimming gain ratio corresponding to a maximum value of data that can be output for a fifth time.

A signal corresponding to luminance changed through the first correction step 1211 may be transmitted to go through the second correction step 1212 or go through the first correction step 1211 again. The signal is made to go through the first correction step 1211 again instead of moving to the second correction step 1212 from the first correction step 1211 in a case where a target gamma gray level is set again in response to another signal received during the first correction step 1211. When the target gamma gray level has to be set again, the first through fourth correction steps 1211 through 1214 may be performed again, starting from the first correction step 1211.

A signal corresponding to luminance changed through the second correction step 1212 may be transmitted to go through the third correction step 1213 or go through the first correction step 1211 again. The signal is made to go through the first correction step 1211 again instead of moving to the third correction step 1213 from the second correction step 1212 in a case where the target gamma gray level is set again in response to another signal received during the second correction step 1212. When the target gamma gray level has to be set again, the first through fourth correction steps 1211 through 1214 may be performed again, starting from the first correction step 1211.

A signal corresponding to luminance changed through the third correction step 1213 may be transmitted to go through the fourth correction step 1214 or go through the first correction step 1211 again. The signal is made to go through the first correction step 1211 again instead of moving to the fourth correction step 1214 from the third correction step 1213 in a case where the target gamma gray level is set again in response to another signal received during the third correction step 1213. When the target gamma gray level has to be set again, the first through fourth correction steps 1211 through 1214 may be performed again, starting from the first correction step 1211.

Figure 16:
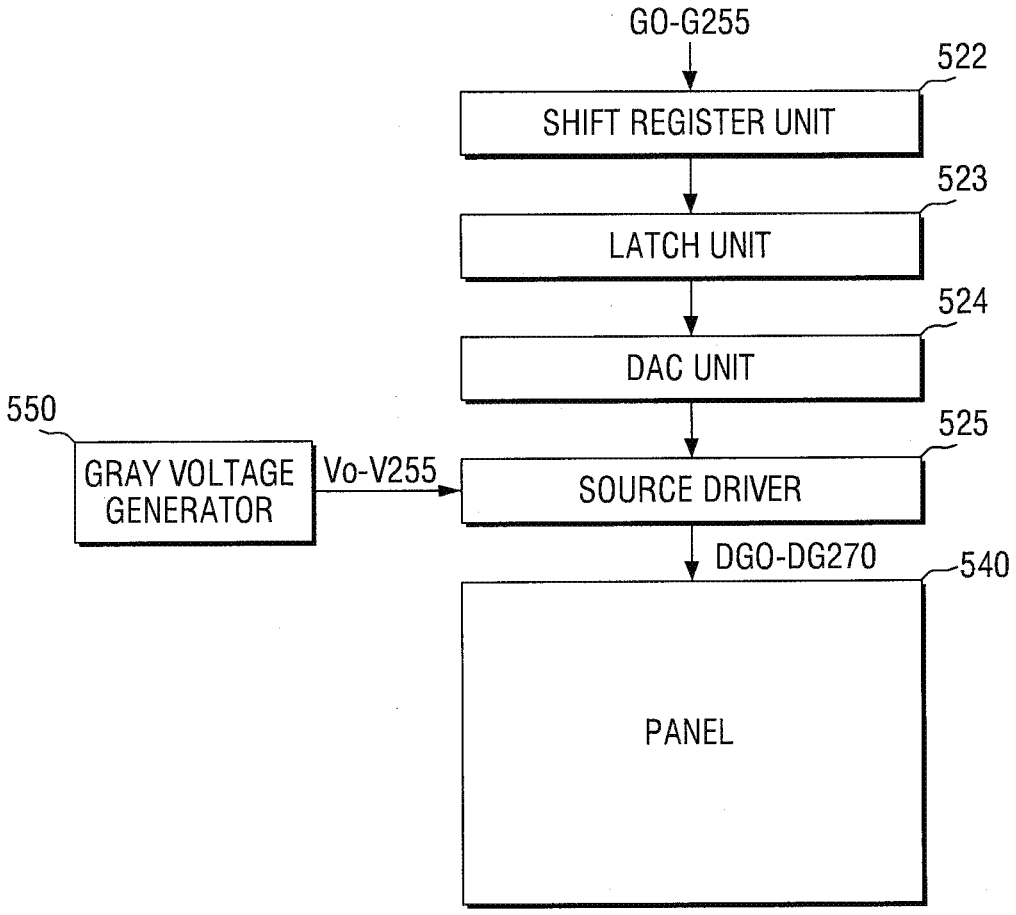
FIG. 16 is a block diagram illustrating the structure of a data driver according to another embodiment of the present invention.

FIG. 16 is a block diagram illustrating the structure of a data driver 520 according to another embodiment of the present invention.

Referring to FIG. 16, the data driver 520 may include a shift register unit 522, a latch unit 523, a DAC unit 524, and a source driver 525.

The shift register unit 522 sequentially generates m' (m' may be 256 in the current embodiment) sampling signals by shifting a source start pulse SSP in each period of a source shift clock SSC. To this end, the shift register unit 522 may include m' shift registers 5221 through 522*m'*.

The latch unit 523 sequentially stores input image data G0 through G255 in response to the sampling signals sequentially received from the shift register unit 522.

To this end, the latch unit 523 may include m' latches 5231 through 523*m'* to store m' input image data G0 through G255. In addition, the latch unit 523 receives the source output enable signal SOE from the timing controller 110. The latch unit 523 supplies the input image data G0 through G255 stored therein to the DAC unit 524.

The DAC unit 524 receives the input image data G0 through G255 from the latch unit 523 and generates m' data voltages. To this end, the DAC unit 524 may include m' DACs 5241 through 524*m'*. That is, the DAC unit 524 generates the m' data voltages using the DACs 5241 through 524*m'* corresponding to each channel and supplies the m' data voltages to the source driver 525.

The source driver 525 generates dimming input image data DG0 through DG270 from the m' data voltages supplied from the DAC unit 524 by using a dimming unit 5252 (see FIG. 17), corrects the dimming input image data DG0 through DG270 to data of desired gray levels using gray voltages V0 through V270 provided by a gray voltage generator 550, and provides the data of the desired gray levels to a display panel 540. The structure of the source driver 525 will now be described with reference to FIG. 17.

Figure 17:
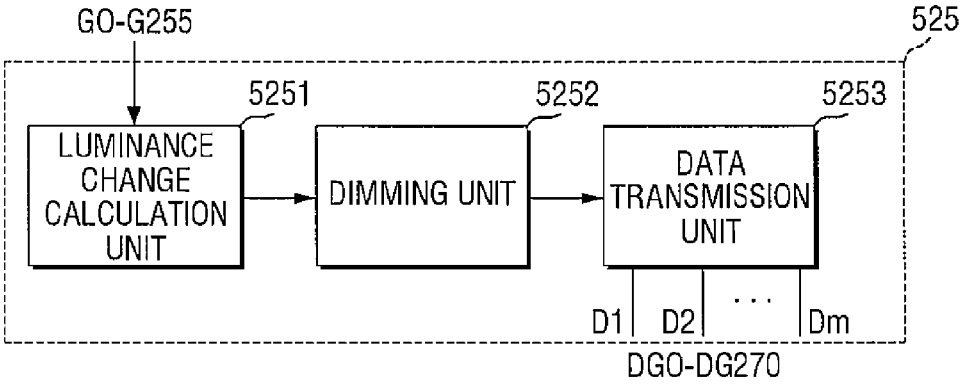
FIG. 17 is a block diagram illustrating the structure of a source driver according to another embodiment of the present invention.

FIG. 17 is a block diagram illustrating the structure of the source driver 525 of FIG. 16.

Referring to FIG. 17, the source driver 525 may include a luminance change calculation unit 5251, the dimming unit 5252, and a data transmission unit 5253.

The luminance change calculation unit 5251 may determine a change in luminance that will be applied to the display panel 540 by analyzing the input image data G0 through G255 transmitted to the source driver 525. The luminance change calculation unit 5251 may determine whether to change luminance using a dimming gain ratio by sensing a change in the luminance during a certain frame.

Since the operating principle of the dimming unit 5252 has been described in detail with reference to FIGS. 4 through 8, a repetitive description thereof will not be provided again.

The data transmission unit 5253 supplies the gray voltages V0 through V270 corresponding to the dimming input image voltages DG0 through DG270 provided by the dimming unit 5252 to m data lines D1 through Dm, respectively.

One or more embodiments of the present invention provide at least one of the following enhancements.

That is, even when luminance is changed slowly, it can be changed naturally.

However, the effects of the present invention are not restricted to the one set forth herein. The above and other effects of the present invention will become more apparent to one of daily skill in the art to which the present invention pertains by referencing the claims.

While the present invention has been particularly shown and described with reference to exemplary embodiments thereof, it will be understood by those of ordinary skill in the art that various changes in form and details may be made therein without departing from the spirit and scope of the present invention as defined by the following claims. It is therefore desired that the present embodiments be considered in all respects as illustrative and not restrictive, reference being made to the appended claims and equivalents thereof rather than the foregoing description to indicate the scope of the invention.

What is claimed is:

1. A display device comprising:

a display unit comprising a plurality of pixels; and a control unit to adjust luminance by maintaining the same gamma gray voltage during a plurality of frames and changing a dimming gain ratio of input data in each frame of the plurality of frames if a luminance level changes during the frames, wherein the control unit comprises:

a gray voltage generator to generate the gamma gray voltage; and a data driver to provide a data signal corrected by the gamma gray voltage to the display unit, wherein the data driver comprises a shift register unit, a latch unit, a DAC unit, and a source driver, and wherein the source driver is connected to output dimming input image data obtained by multiplying the input data by the dimming gain ratio, wherein the data driver comprises a dimming unit to output dimming input image data obtained by multiplying the input data by the dimming gain ratio, wherein the source driver comprises:

a luminance change calculation unit to determine the amount of change in luminance during the frames; and a data transmission unit to receive the dimming input image data from the dimming unit and provide a data signal to the display unit, and wherein the gray voltage generator is connected to the data transmission unit to provide the gamma gray voltage.

2. The display device of claim 1, wherein the data driver comprises a dimming unit to output dimming input image data obtained by multiplying the input data by the dimming gain ratio.

3. The display device of claim 2, wherein the dimming gain ratio is a ratio of a maximum size of data that can be output to a maximum size of the input data.

4. The display device of claim 3, wherein when the input data is N bits, the maximum size of the input data is $2^N-1$.

5. The display device of claim 2, wherein the data driver comprises a shift register unit, a latch unit, a digital-analog converter (DAC) unit, and a source driver.

6. The display device of claim 5, wherein the dimming unit is connected to provide the dimming input image data to the shift register unit, and wherein the gray voltage generator is connected to the DAC unit to provide the gamma gray voltage.

7. The display device of claim 1, wherein when the duration of the frames is less than 1/15 seconds, the control unit is connected to adjust the luminance by changing the gamma gray voltage in each frame.

8. A method of adjusting luminance of a display device, the method comprising:

measuring a frame duration during which a luminance level changes; and maintaining the same gamma gray voltage during a plurality of frames and changing a dimming gain ratio of input data in each frame of the plurality of frames if the luminance level changes during the frames, the maintaining of the same gamma gray voltage and changing of the dimming gain ratio comprising:

determining, by a luminance change calculation unit, the amount of change in luminance during the frames;

multiplying the input data by the dimming gain ratio;

outputting, by a dimming unit, dimming input image data obtained by multiplying the input data by the dimming gain ratio;

providing, by a gray voltage generator, the gamma gray voltage; and receiving, by a data transmission unit, the dimming input data from the dimming unit and providing, by the data transmission unit, a data signal corrected by the gamma gray voltage to a display unit.

9. The method of claim 8, further comprising outputting dimming input image data obtained by multiplying the input data by the dimming gain ratio.

10. The method of claim 9, wherein the dimming gain ratio is a ratio of a maximum size of data that can be output to a maximum size of the input data.

11. The method of claim 10, wherein when the input data is N bits, the maximum size of the input data is $2^N-1$.

12. The method of claim 9, further comprising correcting the dimming input image data utilizing the gamma gray voltage.

13. The method of claim 8, further comprising adjusting luminance by changing the gamma gray voltage in each frame when the frame duration during which the luminance level changes is less than 1/15 seconds.

14. A method of adjusting luminance of a display device, the method comprising:

measuring a frame duration during which a luminance level changes;

receiving a change signal for changing the luminance level; and maintaining the same gamma gray voltage during a plurality of frames and changing a dimming gain ratio of input data in each frame of the plurality of frames if the luminance level changes during the frames, wherein when the change signal is received before the duration of the frames ends, the gamma gray voltage corresponding to the change signal is maintained during the duration of the frames from a frame subsequent to the receiving of the change signal, wherein the maintaining of the same gamma gray voltage and changing of the dimming gain ratio of input data comprises:

determining, by a luminance change calculation unit, the amount of change in luminance during the frames;

multiplying the input data by the dimming gain ratio;

outputting, by a dimming unit, dimming input image data obtained by multiplying the input data by the dimming gain ratio;

providing, by a gray voltage generator, the gamma gray voltage; and receiving, by a data transmission unit, the dimming input data from the dimming unit and providing, by the data transmission unit, a data signal corrected by the gamma gray voltage to a display unit.

15. The method of claim 14, further comprising outputting dimming input image data obtained by multiplying the input data by the dimming gain ratio.

16. The method of claim 15, wherein the dimming gain ratio is a ratio of a maximum size of data that can be output to a maximum size of the input data.

17. The method of claim 14, wherein when the input data is N bits, the maximum size of the input data is $2^N-1$.

* * * * *